US006253400B1

(12) United States Patent
Rüdt-Sturzenegger et al.

(10) Patent No.: US 6,253,400 B1
(45) Date of Patent: Jul. 3, 2001

(54) CUSHION

(75) Inventors: Sylvia Rüdt-Sturzenegger; Christoph Rüdt-Sturzenegger, both of Zurich (CH)

(73) Assignee: Troesch Scheidegger Werner AG, Zurich (CH)

( * ) Notice: Subject to any disclaimer, the term of this patent is extended or adjusted under 35 U.S.C. 154(b) by 0 days.

(21) Appl. No.: 09/446,605

(22) PCT Filed: Jun. 23, 1998

(86) PCT No.: PCT/CH98/00270

§ 371 Date: May 11, 2000

§ 102(e) Date: May 11, 2000

(87) PCT Pub. No.: WO98/58569

PCT Pub. Date: Dec. 30, 1998

(30) Foreign Application Priority Data

Jun. 24, 1997 (CH) ..... 1523/97

(51) Int. Cl.[7] ..... A47C 16/00

(52) U.S. Cl. ..... 5/655; 5/630; 5/657; 5/922

(58) Field of Search ..... 5/630, 632, 640, 5/490, 655, 657, 922, 951

(56) References Cited

U.S. PATENT DOCUMENTS

| | | | | |
|---|---|---|---|---|
| 3,327,330 | * | 6/1967 | McCullough | 5/640 |
| 4,731,890 | * | 3/1988 | Roberts | 5/655 |
| 5,103,514 | * | 4/1992 | Leach | 5/922 X |
| 5,445,349 | * | 8/1995 | Hart | 5/951 X |
| 5,584,086 | * | 12/1996 | VanWinkle et al. | 5/640 X |
| 5,836,024 | * | 11/1998 | Uglehus et al. | 5/630 X |

FOREIGN PATENT DOCUMENTS

| | | |
|---|---|---|
| 195 32 924 | 4/1996 | (DE) . |
| 295 19 799 | 5/1996 | (DE) . |
| 296 04 156 U | 5/1996 | (DE) . |

* cited by examiner

*Primary Examiner*—Michael F. Trettel
(74) *Attorney, Agent, or Firm*—Crowell & Moring, L.L.P.

(57) ABSTRACT

A cushion, particularly positioning, supporting and nursing cushion, has a tubular cushion body which is formed of or filled with a flexible or shape-variable filler material. A cushion cover encloses the cushion body. At least one fastening device is mounted on an end area on the cushion cover or the cushion body, and can be brought into a detachable connection with at least one anchoring point mounted on the interior side of the cushion cover or the exterior side of the cushion body.

6 Claims, 2 Drawing Sheets

CUSHION

This application claims priority of 1523/97, filed on Jun. 24, 1997, and PCT/CH98/00270 filed on Jun. 23, 1998, the disclosure of which is expressly incorporated by reference herein.

BACKGROUND AND SUMMARY OF THE INVENTION

The present invention relates to a cushion particularly a positioning, supporting and nursing cushion.

Tubular and U-shaped cushions exist, for example, for the physiotherapeutic field. These are filled with a flexible filler material, such as styropore balls, millet or a similar material. These cushions are used for therapies, such as physiotherapy, for general patient care, for geriatric care, but also in the private sector. These cushions can be obtained in various sizes. They are filled relatively loosely with the above-mentioned material. The cushions are frequently also used in pregnancy as rest cushions or positioning cushions. Smaller U-shaped cushions which are tightly filled are obtainable for nursing purposes. A mother, who is sitting upright, will place such a cushion around her stomach and position the child on the cushion. This permits a relaxed nursing.

It was an object of the present invention to find a cushion which can be adapted in a variable manner with respect to its shape and firmness to the user's requirements.

According to the invention, this object is achieved by mounting at least one fastening device on the cushion cover or the cushion body so as to be bringable into a detachable connection with at least one anchoring point on the cover or body.

The cushion suggested according to the invention advantageously combines, for example, the positioning/supporting cushion with the nursing cushion. During pregnancy, the tubular and U-shaped cushion can be used in its full length and thus with a loose filling as a positioning and supporting cushion. As the result of the invention, the size of the cushion can be variably reduced and the filling can therefore be made firmer for the purpose nursing. The cushion can meet two requirements by means of one product.

The cushion can also be used in the physiotherapeutic field and in the field of general patient care. Here also, the variable adjusting of the size and the firmness offers the optimal possibility of meeting the patient's requirements as well as those connected with the therapy.

The advantageous characteristics make the cushion according to the invention also particularly suitable for the realm of normal living in that the variability increases the comfort in comparison to conventional cushions.

An embodiment of the invention will be explained in detail in the following by means of drawings.

It is an advantage of the present invention that the size and the filling of the cushion can be reduced and firmed in a variable manner, as illustrated by the following description of the figures.

DETAILED DESCRIPTION OF THE DRAWINGS

Other objects, advantages and novel features of the present invention will become apparent from the following detailed description of the invention when considered in conjunction with the accompanying drawings.

Figure 1:
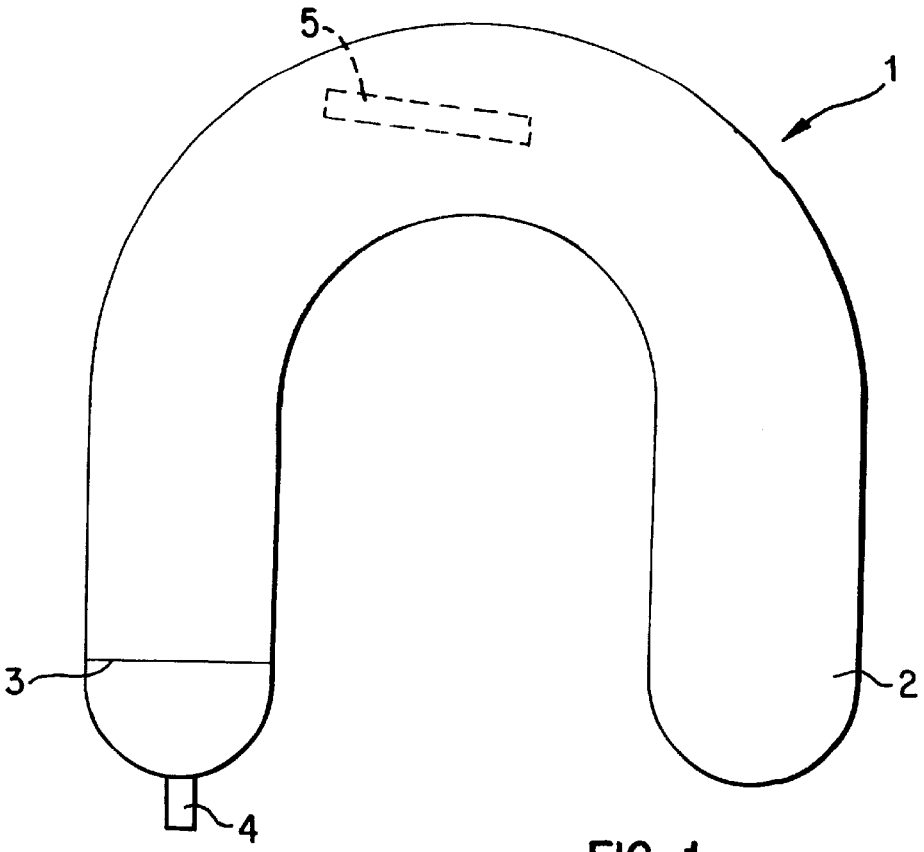
FIG. 1 is a view of a cushion according to the invention.

FIG. 1 illustrates a cushion 1 according to the invention, which has, for example, the shape of a U-shaped tube with an approximately round cross-section. On its one end, the cushion cover 2 has a filling seam or opening 3 through which the cushion it or the cushion body can be inserted in the cushion cover 2. Preferably, a strap 4 is now attached as a fastening device to this cushion end, which strap is produced, for example, of the same material as the cushion cover 2. On the interior side of the cushion cover 2, a fleece or Velcro brand hook and loop fastener strip 5 is attached as an 15 anchoring element.

Figure 2:
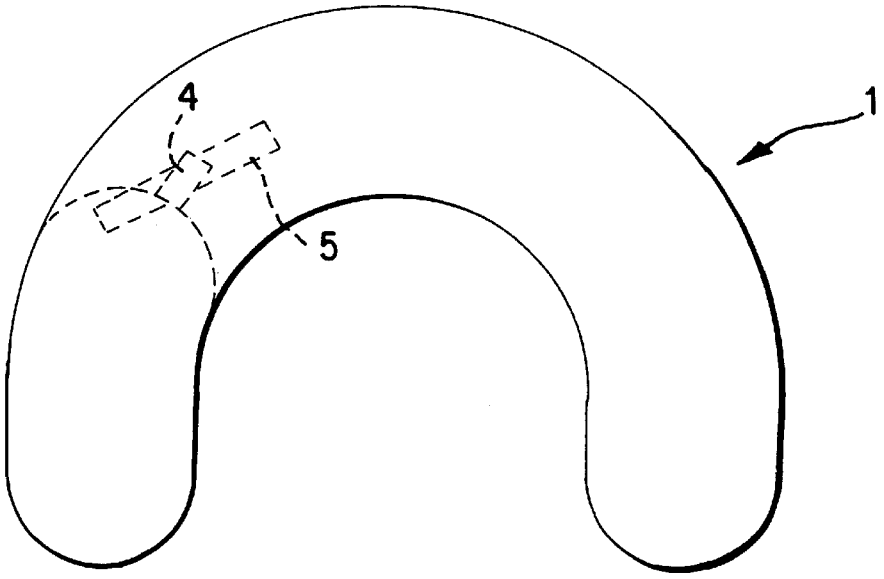
FIG. 2 is a view of the cushion of FIG. 1 in a reduced, firmed state.

If the strap 4 also has a Velcro strip area, by means of the folding-in of the cushion end with the strap 4 through the filling seam 3, the length of the cushion 1 can be reduced, as illustrated in FIG. 2. In this case, the strap 4 can advantageously easily be connected with the Velcro brand strip 5, whereby this reduced shape is fixed. The firmness of the cushion 1 was increased by reducing the size of the cushion, in that, in comparison to the starting form, the filling material becomes denser. Advantageously, the Velcro brand hook and loop fastener strip as well as the strap 4 are situated in a covered manner in the interior of the cushion cover 2, whereby neither the appearance of the cushion nor the comfort is impaired.

Corresponding to the arrangement of the Velcro brand strip 5, either virtually a continuous adjustment of the cushion size can take place over a certain range, or by the positioning of several Velcro strips 5, a discrete reduction or increase in size of the cushion can take place.

Figure 3:
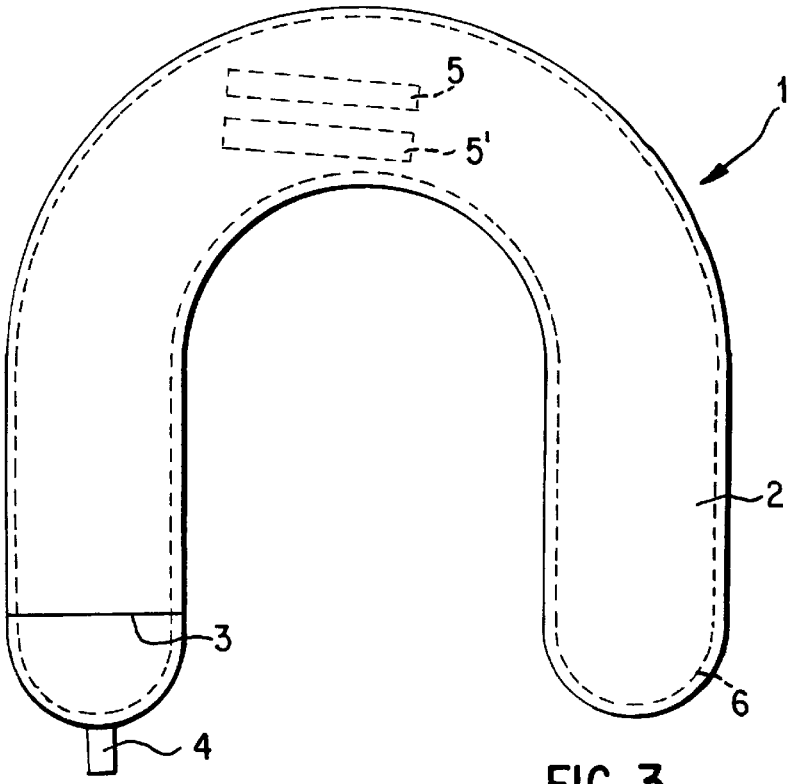
FIG. 3 is a view of the cushion according to FIG. 1 but with multiple Velcro strips.
Figure 4:
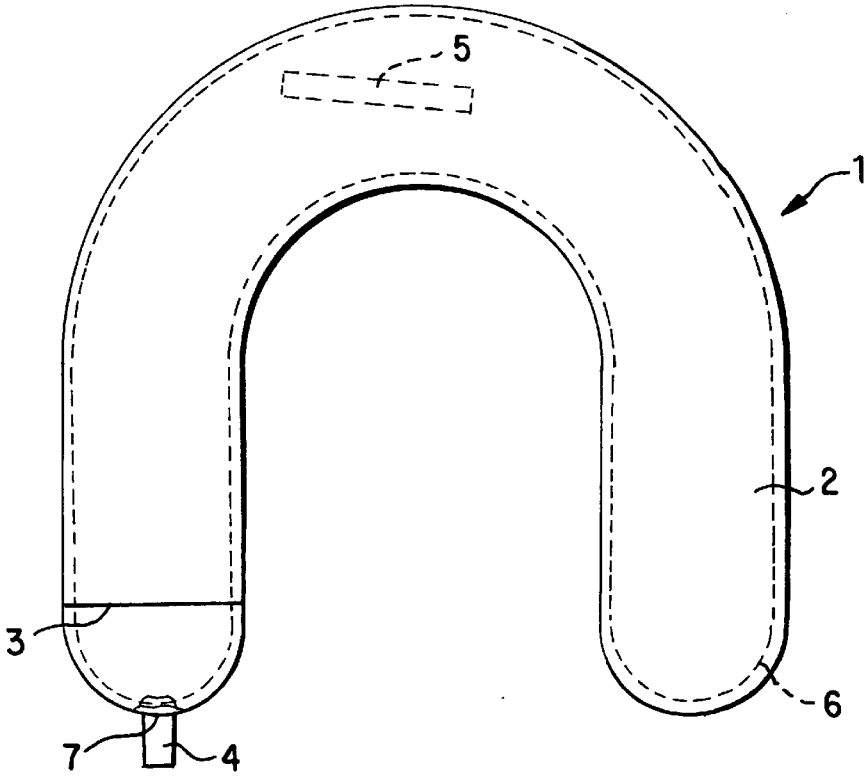
FIG. 4 is the view of the cushion of FIG. 1 in an alternative embodiment.

As illustrated above, the strap 4 can now be fastened on the exterior side of the cushion cover 2, as illustrated again in FIG. 3, or on the corresponding end of the cushion body 6, which is enclosed by the cushion cover 2, as illustrated in FIG. 4. In the latter case, the strap 4 can be pulled for its use through a groove or opening 7 situated at the corresponding end of the cushion cover 2 and, when not in use, it can be stored again in the interior of the cushion cover 2.

Another possibility is provided in that a portion of the cushion cover 2 preferably has a double, that is, overlapping construction starting from the filling opening 3, so that a pocket is formed. The Velcro brand strip 5 is now arranged in the area of this pocket. The strap 4 can now, for example, by guided through the filling opening 3 to the interior into the pocket and can be fastened to the Velcro brand hook and loop fastener strip 5.

The Velcro brand strip 5 can naturally also be mounted on the outside on the cushion cover 2. This solution has the disadvantage that, in the not reduced condition, the Velcro strip will be visible and, in the reduced condition, a portion of the cushion cover 2 is folded over in a visible manner and is therefore not covered. However, if the appearance aspect is not important and only the functionality matters, this is the simplest solution.

Instead of the described solutions with a Velcro fastener, preferably alternative solutions, such as snap fasteners or normal buttons with a strap or hook and eye/straps can be used as connection devices. However, in this case, only discrete and not continuous adjusting possibilities are implemented.

The filler material of the cushion, which preferably consists of plastic balls or grains, can be filled into the cushion cover either directly or can be situated in a cushion body 6.

What is claimed is:

1. Cushion (1) having a tubular cushion body (6) which is formed of or filled with a flexible or shape-variable filler material, and having a cushion cover (2) which encloses the cushion body (6), wherein at least one fastening device (4) is mounted on an end area of one of the cushion cover (2) and the cushion body 6 and is arranged to be brought into a detachable connection with at least one anchoring point (5) mounted on an interior side of one of the cushion cover (2) and on the cushion body (6).

2. Cushion according to claim 1, wherein an opening (7) for storing the fastening device (4) is formed on an end area of the cushion cover (2).

3. Cushion according to claim 1, wherein the fastening device (4) is a strap made of at least one of cloth, leather and plastic.

4. Cushion according to claim 1, wherein the detachable connection between the at least one fastening device (4) and the at least one anchoring point (5) is one of a hook and loop fastener, a button fastener and a snap fastener.

5. Cushion according to claim 4, wherein spaced Velcro strips (5) are mounted on the interior side of one of the cushion cover (2) and the cushion body (6).

6. Cushion according to claim 1, wherein the filler material consists of one of plastic balls.

* * * * *